United States Patent [19]

Boyd

[11] Patent Number: 5,022,203

[45] Date of Patent: Jun. 11, 1991

[54] VENT RIDGE ASSEMBLY

[75] Inventor: Thomas J. Boyd, Wellsburg, W. Va.

[73] Assignee: The Louis Berkman Company, Steubenville, Ohio

[21] Appl. No.: 559,160

[22] Filed: Jul. 27, 1990

[51] Int. Cl.[5] ..... F24F 7/00

[52] U.S. Cl. ..... 52/199; 52/302; 98/42.21

[58] Field of Search ..... 52/302, 303, 199, 408; 98/42.21

[56] References Cited

U.S. PATENT DOCUMENTS

| | | | |
|---|---|---|---|
| 2,416,284 | 2/1947 | Brown | 98/42.21 |
| 4,280,399 | 7/1981 | Cunning | 98/42.21 |
| 4,558,637 | 12/1985 | Mason | 52/199 |
| 4,643,080 | 2/1987 | Trostle et al. | 98/42.21 |
| 4,876,950 | 10/1989 | Rudeen | 98/42.21 |
| 4,924,761 | 5/1990 | MacLeod et al. | 98/42.21 |

*Primary Examiner*—Richard E. Chilcot, Jr.
*Assistant Examiner*—Kien T. Nguyen
*Attorney, Agent, or Firm*—Body, Vickers & Daniels

[57] ABSTRACT

A vent ridge assembly for a metal roof includes a pair of adjacent roof sections spaced from one another. Each of the roof sections is constructed of a roof substrate, a batten overlying and extending along a longitudinal edge of the substrate and one or more roofing panels overlying the roof substrate and spaced from the batten. A plate overlying the batten has one longitudinal edge extending along the length of the batten and a second opposing longitudinal edge overlying a roofing panel. A ridge cap overlies the panels of the adjacent roof sections and has first and second coupling flanges receiving the second opposing longitudinal edges of the plates. A corrugated sheet is disposed between the plate and the batten of each roof section for venting air and water vapor from the beneath the roof.

21 Claims, 4 Drawing Sheets

FIG. 1
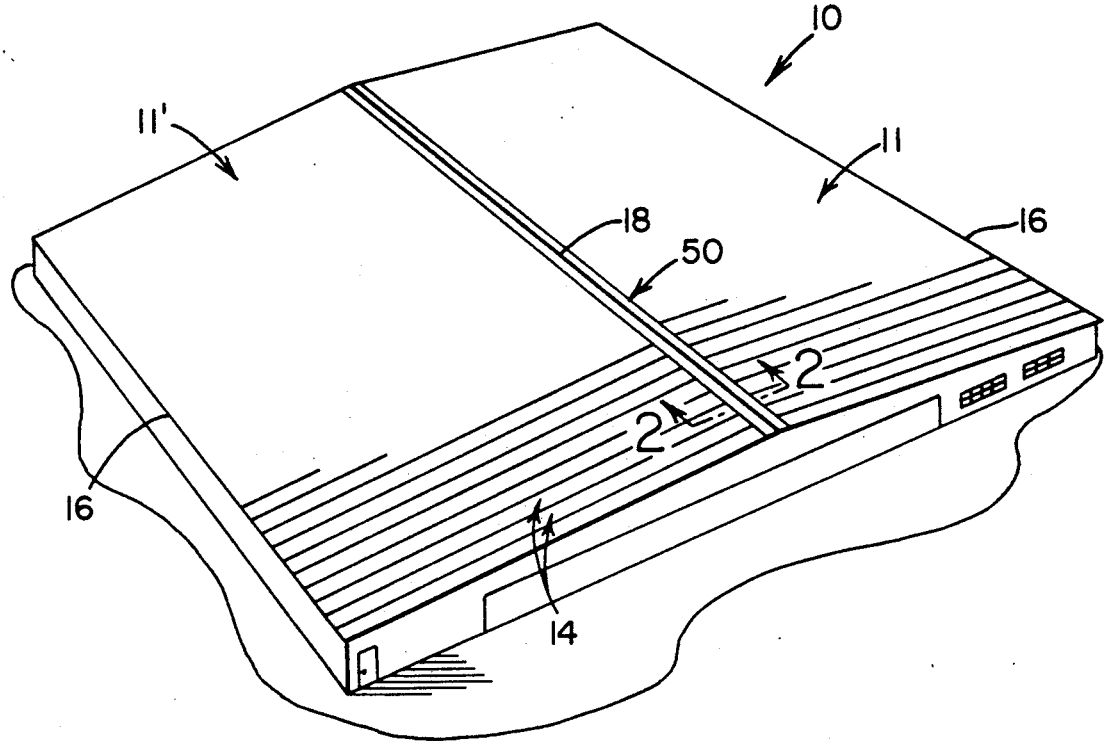
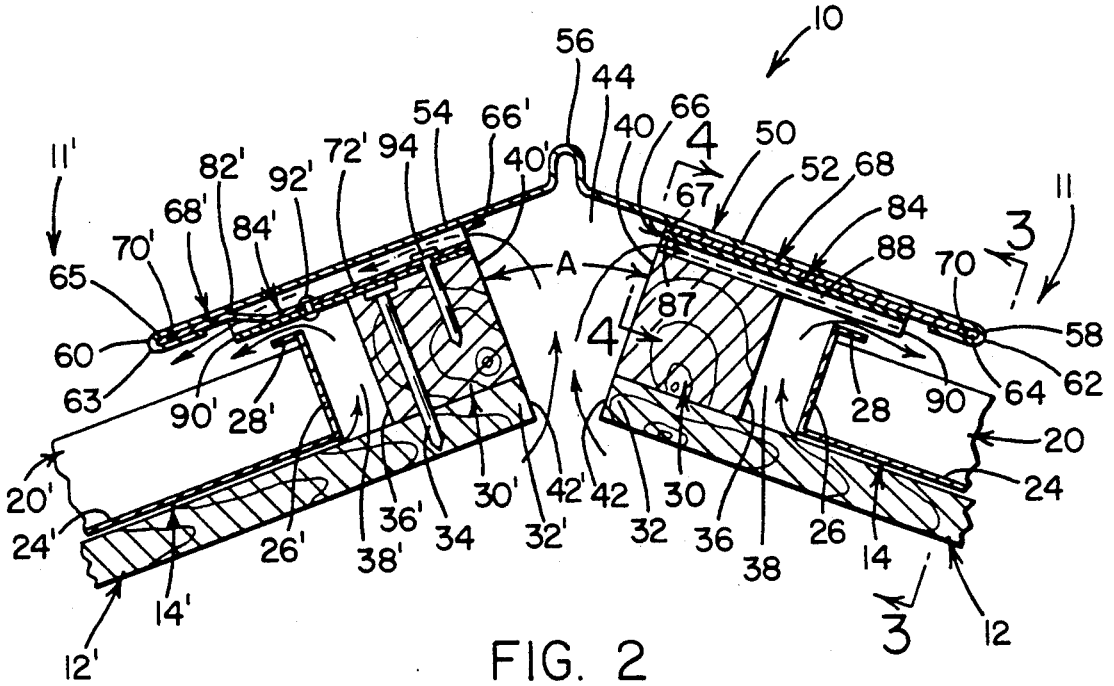
FIG. 2

VENT RIDGE ASSEMBLY

The present invention pertains to the art of sheet metal roofing assemblies, and particularly to a vent ridge assembly for venting air and water vapor from beneath the roofing assemblies.

RELATED PENDING APPLICATIONS

This application relates to U.S. application Ser. No. 459,952 entitled "Lap Joint Roof Assembly", filed Jan. 2, 1990 and U.S. patent application Ser. No. 415,554 entitled "Roofing System Using Standing Joints", filed Oct. 2, 1989, both of which are assigned to a common assignee with the present application.

BACKGROUND OF THE INVENTION

Sheet metal panels are commonly used as components of commercial roofing structures. An assembly of sheet metal panels is fastened together to form a generally flat cover over a roof substrate which may comprise a framework of wood or metal joints, a plywood surface supported on an underlying framework of joints, poured concrete, or the like. Various types of joints are used to fasten the panels into a strong and water tight cover assembly. Standing seam joints comprise a folded connection between adjacent panels which extend vertically upward from the panels along the length of the joint. A novel standing seam joint structure and a lap joint having a primarily horizontal configuration across the joint panels are the subjects of other patent applications, mentioned herein before.

A ridge cap covering the adjacent edges of roof panels has been well known in the prior art. Typically, the ridge cap was attached to flat strips of metal which in turn were attached to battens which extended longitudinally along the edges of adjacent roof panels. The flat strips of metal overlied the metal sheets covering the roof decking. Air from beneath the roof was vented by providing spaced openings along the length of the battens to vent the space between the adjacent roof panels under the ridge cap. The provision for venting was very important because warm air, for example, up to approximately 180° Fahrenheit, accumulated under the ridge cap during the day and then cooled to about 25° Fahrenheit at night. Without venting, water condensation caused by the temperature variations accumulated in the space under the ridge cap and eventually caused damage to the roof structure. To overcome this problem, it was known in the prior art to cut a plurality of spaced openings along the battens. This enabled the air and water vapor, which accumulated under the ridge cap to escape.

A significant problem resulting from this design was the invasion of insects, such as bees, into the space below the ridge cap and ultimately throughout the building covered by the roof. Screens were sometimes used to prevent insect infestation.

Another disadvantage of the prior design was the unsightly appearance of the holes in the battens extending along the ridge of the roof. This required special care to conceal.

A still further disadvantage of the prior design was the additional construction time required to cut the vent spaces in the battens during the on site construction.

The prior art has been unable to provide a vent ridge assembly which enables air and vapor condensation to escape from beneath a roof while preventing the invasion of insects, eliminating unsightly building appearance and reducing the cost of construction.

SUMMARY OF THE INVENTION

The present invention overcomes the above-described disadvantages and others and provides a vent ridge assembly for a sheet metal roofing assembly which forms a vent for the space adjacent the ends of spaced roof panels at the ridge of the roof as well as an efficient and relatively inexpensive means of manufacturing and installing the assembly.

In accordance with the invention, there is provided a pair of adjacent roof panels typically positioned at an obtuse angle with respect to each other. The longitudinal ends of the roof panels are disposed adjacent to and spaced from each other. This spacing is advantageous in that it reduces the accuracy needed in constructing the roof and further enables the roof to accommodate shifting between the panels due to temperature changes or settling of the building structure itself. Naturally, warm air from within the building structure collects at the ridge of the roof. This air, which often contains water vapor that can condense and cause deterioration of the roofing structure, is vented by the presently disclosed vent ridge assembly from the space between the two roof panels. Regarding each roof panel, a batten overlies and extends along an edge of a roof substrate. A box end pan overlies the roof substrate and is spaced from the batten. A plate overlies the batten and has a first longitudinal edge extending along the length of the batten. A second opposing longitudinal edge of the plate overlies the box end pan. A ridge cap having first and second longitudinally extending flanges for receiving the second longitudinal edge of the plates overlies the box end pans of the panels. Structure is provided between the plate and the batten, extending longitudinally along the length of the batten, for venting air from beneath the roof.

In accordance with a more specific aspect of the invention, the means for venting the air collected in the space between the adjacent roof panels comprises a corrugated sheet overlying the batten and the spaced box end pans. The spaces formed between the grooves of the corrugated sheet and both the plate and the batten provide vent openings to the space between the adjacent roof panels.

Further regarding the corrugated sheet and the panel, they are attached together by rivets. The rivets securely connect them together without anchoring them to the roof substrate. This enables them to be connected before they are anchored to the batten by conventional means, such as nails.

Yet another aspect of the invention provides a plurality of spaced depressions in the plate which fit within the depressions of the corrugated sheet. Holes projecting through the depressions of the plate and corresponding holes through the corrugated sheet are provided to receive the rivets. The holes are also used to receive nails for affixing the assembled corrugated sheet and plate to the batten.

Preferably, a plurality of box end pans are provided along each roof substrate adjacent to the batten. The upstanding end of the box end pan, which is adjacent but spaced from the batten, provides a space through which air from below the pan caused by heat expansion can be vented from beneath the corrugated sheet. It is noteworthy that the corrugated sheet extends over the upstanding wall so that any moisture formed in the space between the pan and the batten will have a tendency to drip back onto the pan to prevent accumulation of moisture and resulting deterioration of the roofing structure.

The principal object of the present invention is to provide a vent ridge assembly which can vent air and moisture from beneath adjoining sheet metal roofing panels.

Another object of the present invention is to provide a vent ridge assembly which can be easily and efficiently installed without a great deal of expertise.

A yet further object of the present invention is to provide a vent ridge assembly which is relatively inexpensive to manufacture and install.

A still further object of the present invention is to provide a vent ridge assembly which substantially prevents the invasion of insects to the space below the roof structure without the use of screening.

Another object of the present invention is to provide a vent ridge assembly which is not visually observable from outside of the roofing structure.

These and other objects of the invention will become apparent from the following description of a preferred embodiment thereof taken together with the accompanying drawings.

BRIEF DESCRIPTION OF THE DRAWINGS

FIG. 1 is a pictorial view of a building having a roof structure including a vent ridge assembly in accordance with the invention;

FIG. 2 is a cross-sectional view of the vent ridge assembly in accordance with the invention taken along line 2—2 of FIG. 1;

DESCRIPTION OF THE PREFERRED EMBODIMENT

Figure 6:
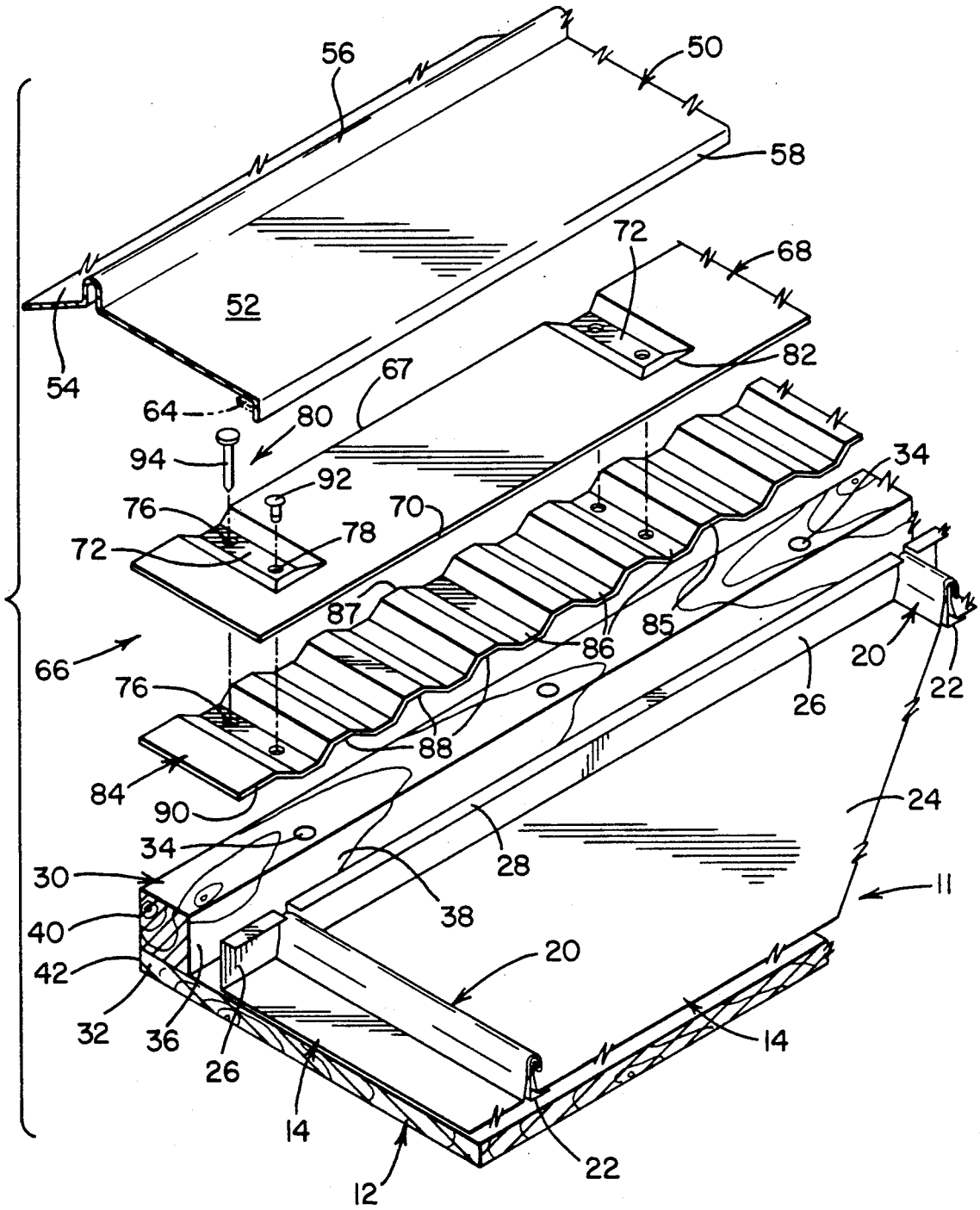

Referring now to the drawings, wherein the showings are for the purpose of illustrating a preferred embodiment of the invention and not for the purpose of limiting the invention, FIGS. 1 and 2 show a roof assembly 10 constructed of adjacently disposed roof sections 11 and 11'. Throughout the specification, elements designated by primed numbers are substantially identical to elements designated by unprimed numbers. Each of the roof sections 11 and 11' include wooden roof substrates 12 and 12'. Roof sections 11 and 11' each comprise a plurality of elongated metal roofing panels 14 and 14' preferably extending from eave 16 to ridge 18. Adjacent panels 14, as shown in FIG. 6, are joined by a joint structure 20. Joint structure 20 preferably extends the length of the adjacent panels 14 and joins them together in a conventional manner. More specifically, joint structure 20 comprises upstanding edges of roofing panels 14, and a cleat 22. Although joint structure 20 is described herein, it does not form a significant aspect of the present invention. Therefore, any conventional joint structure may be substituted. Details of joint structure 20 are disclosed in co-pending U.S. patent application Ser. No. 459,952 which is incorporated in its entirety by reference herein. Each of the roofing panels 14 and 14' includes a major portion 24 and 24', and an upstanding wall 26, 26'. Upstanding wall 26 projects substantially perpendicular to major portion 24 and includes a folded terminal edge 28 which folds back over major portion 24. Each of panels 14, 14' can be rigidly anchored to wooden roof substrates 12 and 12' by any desired means such as nails, not shown.

Referring to FIGS. 2 and 6, there is illustrated a detailed view of roof sections 11 and 11'. Roof section 11 includes a batten 30, typically a length of wood, which is rigidly secured to longitudinally extending edge 32 of roof substrate 12. Typically, batten 30 has a square or rectangular cross-section and is secured to wooden substrate 12 by any desired means such as nails 34. A first side wall 36 of batten 30 is positioned to be adjacent and spaced from upstanding wall 26 of the roofing panel 14 so as to provide an open space 38 which provides a passageway for the flow of air from beneath panels 14 as discussed hereinafter. As best seen in FIG. 2, second side wall 40 of batten 30 which is oppositely disposed from the first side wall 36, is typically aligned with end surface 42 of the roof substrate 12. Typically, roof assembly 10 has the roof substrates 12 and 12' positioned so that second wall 40 of batten 30 and second wall 40' of batten 30' are disposed at an obtuse angle A to each other. Moreover, the walls 40 and 40' are spaced from each other to form a space 44 which can accommodate thermally induced expansion and contraction of roof sections 11 and 11' as well as movement due to the settling of the building supporting the roof 10.

Overlying space 44 between first and second roof sections 11 and 11' is a conventional ridge cap 50 formed of first and second cap panels 52 and 54, respectively, which are connected by a U-shaped hinge section or crown 56. The hinge section 56 enables the cap panels 52 and 54 to accommodate the different angles A with which roof sections 11 and 11' can be positioned with respect to each other. Each of the cap panels 52 and 54 has a free end 58 and 60 respectively, which is bent back on itself, see FIG. 6, to form terminal edges 62 and 63 and open hem pockets 64 and 65. Terminal edges 62 and 63 overlie panels 14 and 14' as illustrated in FIG. 2.

Between ridge cap 50 and battens 30 and 30' lies means 66 and 66' for venting air collected in space 44 beneath ridge cap 50. Each vent means 66 and 66', which form a significant aspect of the present invention, is essentially identical and thus only vent means 66 will be described in detail herein.

Vent means 66, as illustrated in FIGS. 2 and 6, includes a generally flat plate 68 which overlies batten 30 and extends longitudinally along the length of batten 30. A first longitudinally extending edge 67 is aligned with the second side wall 40 of batten 30. The width of plate 68 is such that the second longitudinally extending edge 70 overlies major portion 24 of panel 14. Plate 68 further includes a plurality of spaced depressions 72 extending partially across the width of plate 68 from edge 67. The depressions include through holes 76 and 78 to accommodate attachment means 80 discussed hereinafter. It is noteworthy that the distance between edge 67 and end 82 of depression 72 corresponds to the width of corrugated sheet 84 discussed hereinafter.

Figure 3:
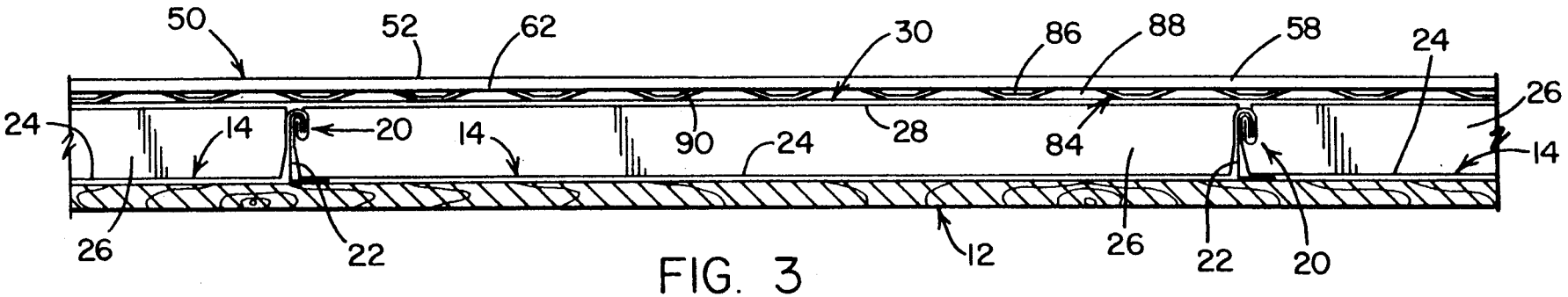
FIG. 3 is a cross-sectional view of the vent ridge assembly taken along line 3—3 of FIG. 2.
Figure 4:
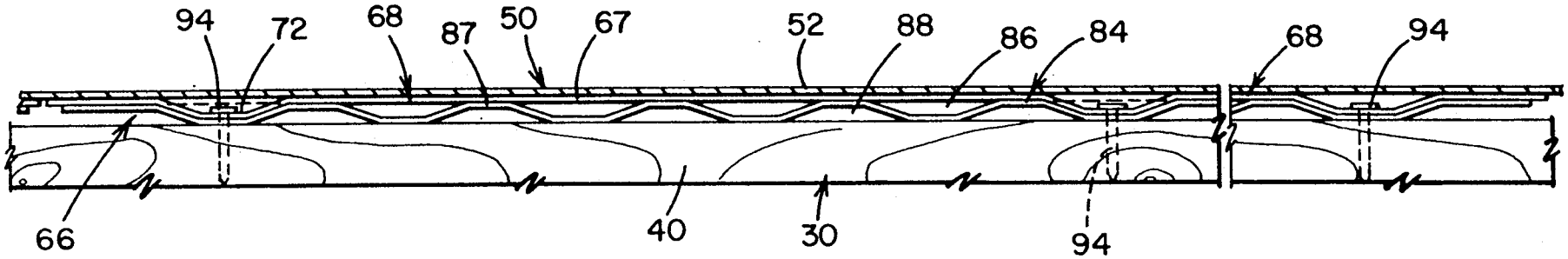
FIG. 4 is a cross-sectional view of the vent ridge assembly taken along line 4—4 of FIG. 2.
Figure 5:
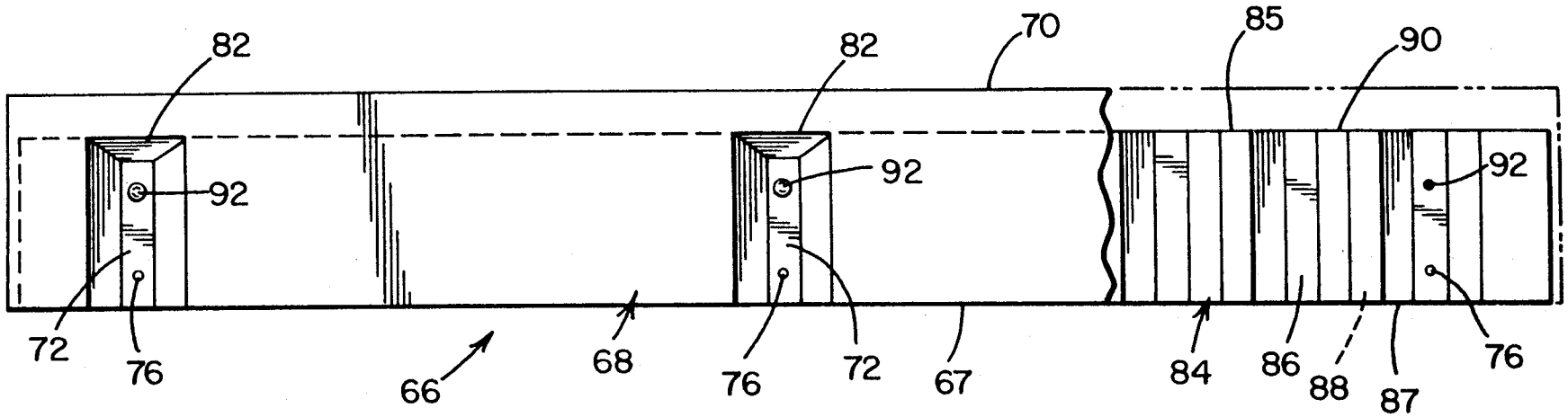
FIG. 5 is a top view, partially cut away, of the assembled plate and corrugated sheet; and, FIG. 6 is an assembly view of the vent ridge assembly in accordance with the present invention.

Corrugated sheet 84 together with plate 68 and batten 30 form vent means 66. The corrugated sheet 84 has first and second longitudinally extending edges 85 and 87 respectively. Corrugated sheet 84 includes a plurality of parallel, spaced depressions or grooves 86 and 88 on the upper and lower sides of corrugated sheet 84 extending transversely to and between the first and second edges 85 and 87. Although the grooves are illustrated as having a cross-sectional shape of a truncated pyramid, it is within the scope of the present invention to provide grooves having any desired cross-section. As best seen in FIG. 4, the assembly of plate 68 and corrugated sheet 84 forms a plurality of vent holes which consist of the space between grooves 86 and 88 and plate 68 and batten 30, respectively. Openings from grooves 86 and 88 are formed along the length of batten 30 and therefore provide a large number of vent openings which efficiently vent the air from space 44. At the same time, these openings, as seen in FIG. 3, are small enough to inhibit insects from flying therethrough.

In order to easily affix corrugated sheet 84 and plate 68 to one another, depressions 72 of plate 68 are preferably shaped to be received within grooves 86 of the corrugated strip. Moreover, edge 90' of corrugated sheet 84' preferably extends to the end of depression 82', as seen on the roof section 11' in FIG. 2. By shaping the depressions 72 to correspond to the grooves 86 of the corrugated sheet, the plate 68 and sheet 84 can be pressed together without distorting either of their shapes. Corrugated sheet 84 and plate 68 are preferably joined together by any desired means such as pop rivets 92. Once corrugated sheet 84 and panel 14 are assembled together, they can be affixed to batten 30 by any desired means such as nails 94 which secure the assembly of sheet 84 and panel 14 to batten 30. After the assembly of corrugated sheet 84 and plate 68 have been attached to batten 30, ridge cap 50 can be affixed to ends 70 and 70' of plates 68 and 68' by simply sliding ridge cap 50 over plates 68 and 68' so that hem pockets 64 and 65 receive ends 70 and 70', respectively.

After roof structure 10 has been assembled, it can be appreciated by the arrows in the illustration of FIG. 2 that the air collected in space 44 under roof assembly 10 can be vented out through openings 86 and 88. In addition, any air which is flowing from under metal panels 14 due to heat expansion or the like can flow through space 38 and across terminal edge 28. It is also noteworthy that the ends 90 and 90' of the corrugated sheets 84 and 84' overlie the major portions 24 and 24' of panels 14 and 14' so that any moisture which forms on the underside of either corrugated sheet 84 or 84' due to the flow of air through space 38, 38' will tend to drip onto panels 14 and 14' and not collect within spaces 38 and 38' which would ultimately lead to deterioration of the roof.

Ridge cap 52 can be either slipped longitudinally over the ends of plates 68 or can be placed on the plates and then have ends 62 formed at the building site. Depressions 72 allow clearance for the rivets and nail to prevent interference with the flat upper surfaces of plates 68.

The invention has been described with reference to a preferred embodiment and it is apparent that many modifications may be incorporated into the design and configuration of the vent ridge assembly discussed herein without departing from the spirit or the essence of the invention. It is my intention to include all such modifications and alterations insofar as they come within the scope of my invention. It is thus the essence of my invention to provide a vent ridge assembly which can be readily adapted and configured to be incorporated in a wide variety of roofing structures.

Having thus described the invention, it is claimed:

1. A vent ridge assembly for a metal roof, comprising: first and second adjacent roof sections each having a longitudinally extending edge spaced from the other, each of said roof sections comprising:

a roof substrate;

a batten overlying and extending along said longitudinally extending edge of said substrate;

one or more roofing panels overlying said roof substrate and spaced from said batten;

a plate overlying said batten, said plate having one longitudinal edge extending along the length of said batten and a second opposing longitudinal edge overlying said one or more roofing panels;

sheet metal means between said plate and said batten, extending longitudinally along the length of said batten, for venting air and water vapor from beneath said metal roof; and a ridge cap overlying and connected to the plates of said first and second roof sections.

2. The vent ridge assembly of claim 1 wherein said means for venting includes a plurality of vent openings.

3. The vent ridge assembly of claim 2 wherein said means for venting includes a corrugated sheet overlying a batten and said plate.

4. The vent ridge assembly of claim 3 wherein said corrugated sheet is disposed between said batten and said plate whereby the space between the grooves of the corrugated sheet and the batten and the surface of the plate form said plurality of vent openings.

5. The vent ridge assembly of claim 4 wherein said corrugated sheet further overlies said one or more roofing panels.

6. The vent ridge assembly of claim 4 wherein said ridge cap has first and second flanges receiving the second opposing longitudinal edge of the plate for each roof panel.

7. The vent ridge assembly of claim 6 wherein said first and second roof sections are disposed at an obtuse angle with respect to each other.

8. The vent ridge assembly of claim 5 wherein said plate is generally flat and has a plurality of spaced depressions which mate within the grooves in the corrugated sheet.

9. The vent ridge assembly of claim 8 further comprising attachment means rigidly affixing the plate and the corrugated sheet to the batten which they overlie.

10. The ridge assembly of claim 9 wherein said attachment means comprises rivets for connecting the corrugated sheet to the plate and nails for connecting the corrugated sheet and plate to the batten which they overlie.

11. The vent ridge assembly of claim 10 wherein said attachment means further includes two holes in each of said depressions on said plate.

12. The vent ridge assembly of claim 11 wherein one of said holes receives a rivet for attaching said corrugated sheet to said plate.

13. The vent ridge assembly of claim 12 wherein the other of said holes receives a nail for attaching the corrugated sheet and the plate to said batten.

14. The vent ridge assembly of claim 1 wherein each of said roofing panels comprises a box end pan.

15. The vent ridge assembly of claim 14 wherein each of said roof sections includes at least two box end pans disposed adjacent each other.

16. The vent ridge assembly of claim 15 wherein each of said box end pans includes an upstanding wall spaced from said batten.

17. A vent ridge assembly for a metal roof, comprising:

a corrugated sheet having first and second longitudinally extending sheet edges, said sheet having a plurality of parallel spaced grooves extending transversely to and between the first and second sheet edges;

a sheet metal plate having first and second longitudinally extending plate edges, said sheet metal plate overlying and in surface contact with said corrugated sheet so that the first sheet edge is in longitudinal alignment with the first sheet edge and said second plate edge projects outward from said first sheet edge to provide a drip surface, adapted to receive condensation from vented air flowing through said grooves.

18. The vented ridge assembly of claim 17 further including means for attaching said corrugated sheet to said sheet metal plate.

19. The vented ridge assembly of claim 18 wherein said means for attaching comprises a plurality of spaced depressions formed on said plate which mate within the grooves in the corrugated sheet.

20. The vent ridge assembly of claim 18 further including:

a longitudinally extending ridge cap overlying said sheet metal plate; said ridge cap having at least one longitudinally extending edge flange receiving the second plate edge to secure the plate to the ridge cap.

21. The vented ridge assembly of claim 19 wherein said means for attaching further includes:

mating holes projecting through depressions in the plate and through the corrugated sheet; and pop rivets received in said mating holes for securely fastening said corrugated sheet to said plate.

* * * * *